United States Patent [19]

Edge

[11] 4,035,861

[45] July 19, 1977

[54] GANGWAY SYSTEM

[75] Inventor: George S. Edge, Fanwood, N.J.

[73] Assignee: Amerada Hess Corporation, New York, N.Y.

[21] Appl. No.: 626,809

[22] Filed: Oct. 29, 1975

[51] Int. Cl.[2] ..... E01D 1/00

[52] U.S. Cl. ..... 14/71.1; 14/72.5; 114/230; 114/263

[58] Field of Search ..... 14/71 R, 71 A; 114/230

[56] References Cited

U.S. PATENT DOCUMENTS

| | | | |
|---|---|---|---|
| 785,400 | 3/1905 | Buchanan | 14/71 X |
| 1,590,317 | 6/1926 | Richards | 14/71.1 |
| 2,372,574 | 3/1945 | Haynes | 14/71 |
| 2,617,131 | 11/1952 | Harris | 14/71 |
| 2,641,785 | 6/1953 | Pitts | 14/71 |
| 2,803,841 | 8/1957 | Wellens | 14/71 |
| 3,004,391 | 10/1961 | Miller | 14/71 X |
| 3,008,158 | 11/1961 | Stinson | 14/71 |

*Primary Examiner*—Nile C. Byers, Jr.

*Attorney, Agent, or Firm*—Arthur A. March

[57] ABSTRACT

Gangway structure providing a connecting link between a vessel and a docking area to permit loading and unloading of the vessel when adjacent to the docking area under the prevalent variable relative positional dispositions of the vessel and docking area due to tidal and water current changes, vessel displacement changes caused by such loading and unloading, and the like, including a gangway structure having means to support one end thereof on the vessel, means to support the other end thereof on the docking area, and means such as cooperating vertical pivot and horizontal axis roller means to preclude the torsional twisting of the gangway structure, e.g., in any position of movement thereof in connecting link relation to the vessel and docking area, and preferably associated tower structures and elevated connecting gangway span supporting means extending between such tower structures for accommodating the docking area supported end of the gangway structure and such means to preclude such torsional twisting.

10 Claims, 4 Drawing Figures

FIG. 3
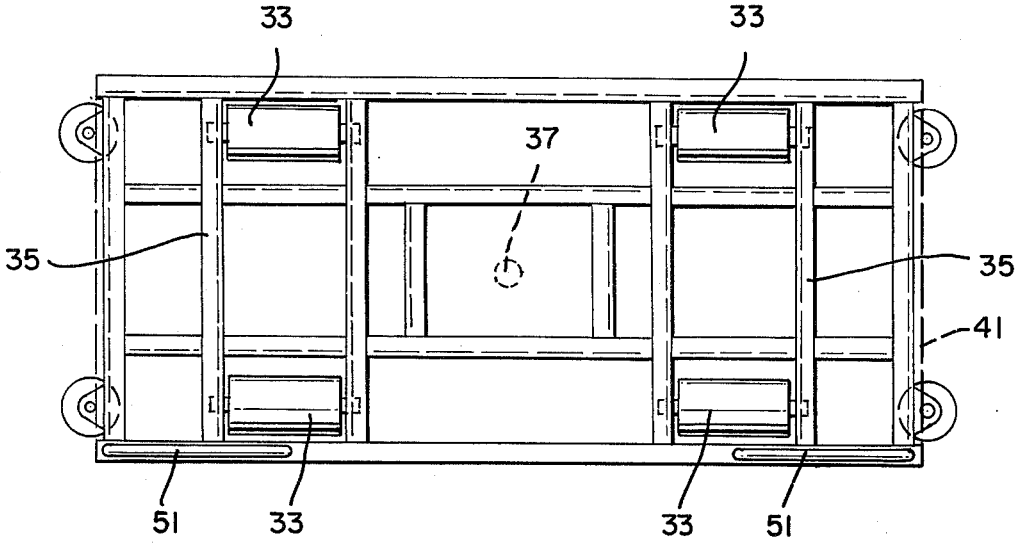
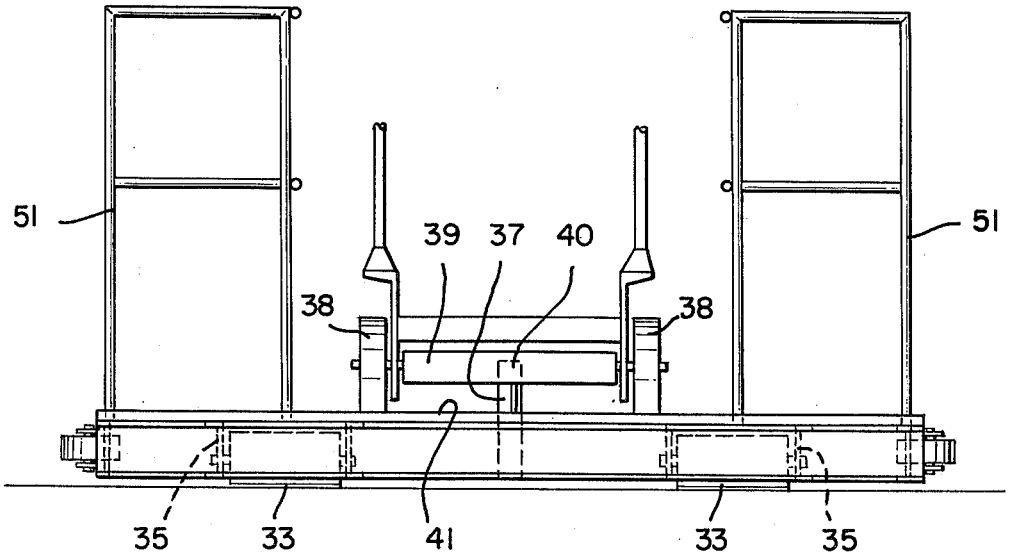
FIG. 4

GANGWAY SYSTEM

BACKGROUND OF THE INVENTION

The invention relates to a gangway or the like for providing ready and safe boarding access between the docking area or pier and a vessel at the dock.

When a vessel, such as a tanker, is moored at the docking area or pier in its loaded condition it will be relatively low in relationship to the height of the pier, but as a vessel is unloaded, the angle of elevation of the ship relative to the pier will become much greater. This change in the disposition of the angular elevation between the vessel and the pier can also occur as a result of providing cargo into the unloaded vessel or as a result of changes in the tide of the water basin itself. As a result great difficulty has been encountered in providing a gangway which will provide access between the docking area and the vessel at all positions of elevation of the vessel relative to the pier itself.

Heretofore attempts have been made to overcome these difficulties in a variety of fashions as, for example, by means of a sliding gangway arrangement or by the provision of telescoping or nesting extensions for the gangway. Such attempts however did not provide for an adjustment of the angular disposition of the gangway while maintaining the gangway in a steady, straight and non-twisting position despite the motion of the vessel laying at times in moving water. Furthermore, the prior attempts to solve the foregoing problems were not economical and lacked safety and other necessary features.

As a consequence, it is the object of the invention to provide a gangway or transfer bridge between the deck of a vessel and the docking surface by means of which a reasonable access angle is continuously maintained between the vessel deck and the docking surface.

It is a further and very improtant object of the invention to provide a gangway in which the free end is of such structure that it precludes any chance of tortional twist of the gangway relative to the place on which the free end of the gangway is rested.

Another object of the invention is to provide a gangway which while eliminating such tortional twist, nevertheless rides or moves back and forth freely to maintain an access angle which can be easily traveled between the vessel and the docking region.

Still another object of the invention is to provide a gangway which is relatively economical to construct and whose supports may be placed upon existing pier structure.

SUMMARY OF THE INVENTION

In its essence, the device herein to be described is quite unique in that, in addition to the other features, in contrast to previously proposed constructions, there is built up at a reasonable distance removed into the land or water from the docking region and the sides of the tanker or vessel as it is brought close to the docking platform, a pair of tower-like supports for the span. Such a support is generally in the form of a tower-like element having support and anchoring piles driven into the bed of either the land area adjacent to the dock or the water body which are sunk to a depth until they are firmly anchored and extend upwardly and outwardly therefrom. As these piles are extended upwardly they are braced at reasonable distances, such as six to ten feet apart to form support towers and between the bracing areas suitable stairways are usually provided to extend up to the height of the piles above the dock surface to bring them to the span height and supporing span plane.

Also extending from the docking area and any existing front platform thereof there are additional columns extending upwardly and likewise suitably braced (as will be explained) and anchored both with respect to the existing platform and with respect to each other to form the second tower. At a suitable height of the existing bracing and between that region and the upward end of the driven piles which support the stairway, a span or gangway carriage is suitably supported in a generally horizontal path. This span extends outwardly from the region of the existing platform of the docking surface to that location whereat the piles are driven and supported to form the first tower. The span can then be held generally parallel to the water surface regardless of the height of the water relative to the existing docking area and the mean low water level. Then, between any existing raised columns and the driven piles and along the span, there is a gangway carriage region, along which the freely movable end of the ship gangway can be rolled between the innermost support of the span and some point outwardly toward the driven piles forming the second tower.

This support region is generally termed a gangway runway and the end of the gangway rested thereon is provided with a gangway carriage so that if the free end of the movable gangway is provided with rollers or the equivalent the gangway as a whole can be moved freely to compensate for different vessel weights tending to permit it to rise from the water or lower into the water or to compensate for any tide differences causing the water level adjacent to the dock to rise or lower.

In this case, the gangway carriage comprises suitable rollers at its free end and these rollers move lengthwise of the span connecting the existing uprights of the tower at the dock formed from the existing piles and the formed tower built up from the newly driven piles and is held against lateral movement by guide channels extending lengthwise along the span between the elevated supports at the dock and the driven piles. Near the end of the span and in the general region of the braced piles there is provided a stairway region from a level substantially corresponding to that of the existing platform or docking area. Also, there is a final stop on the span so that the long movable gangway cannot be removed from or caused to travel beyond the span region.

In connection with this gangway, one of the most important, unique and novel features is the structure presented wherein torsional twisting of the gangway is prohibited. With this structure a non-twisting relation is established by the use of a pivot straddled by a roller member. The roller is fastened to the underside of a side rail and the gangway is prevented from twisting with torsional effect by the riding thereof over the pivot which accommodates such moving. This feature provides a ready access gangway or bridge which is not susecptible of presenting any torsionally twisting conditions.

BRIEF DESCRIPTION OF THE DRAWINGS

Many and distinct advantages result from this form of construction and freedom from any torsional twist of the gangway in its movement is insured by providing a gangway pivot along the span and having it straddled by a roller about which a limited pivotal movement is permitted. These structures are illustrated by the accompanying drawings in which:

FIG. 3 is a schematic representation of a plan view of the structure of FIG. 2; and FIG. 4 is an elevational end view of the structure of FIG. 2 and shows particularly the arrangement of the gangway tread and the roller thereon as movable between the docking region and the outwardly formed piles of the tower and particularly shows the roller and gangway pivot to preclude any torsional twist of the gangway as it moves in the gangway supporting span.

DETAILED DESCRIPTION OF THE INVENTION

Figure 1:
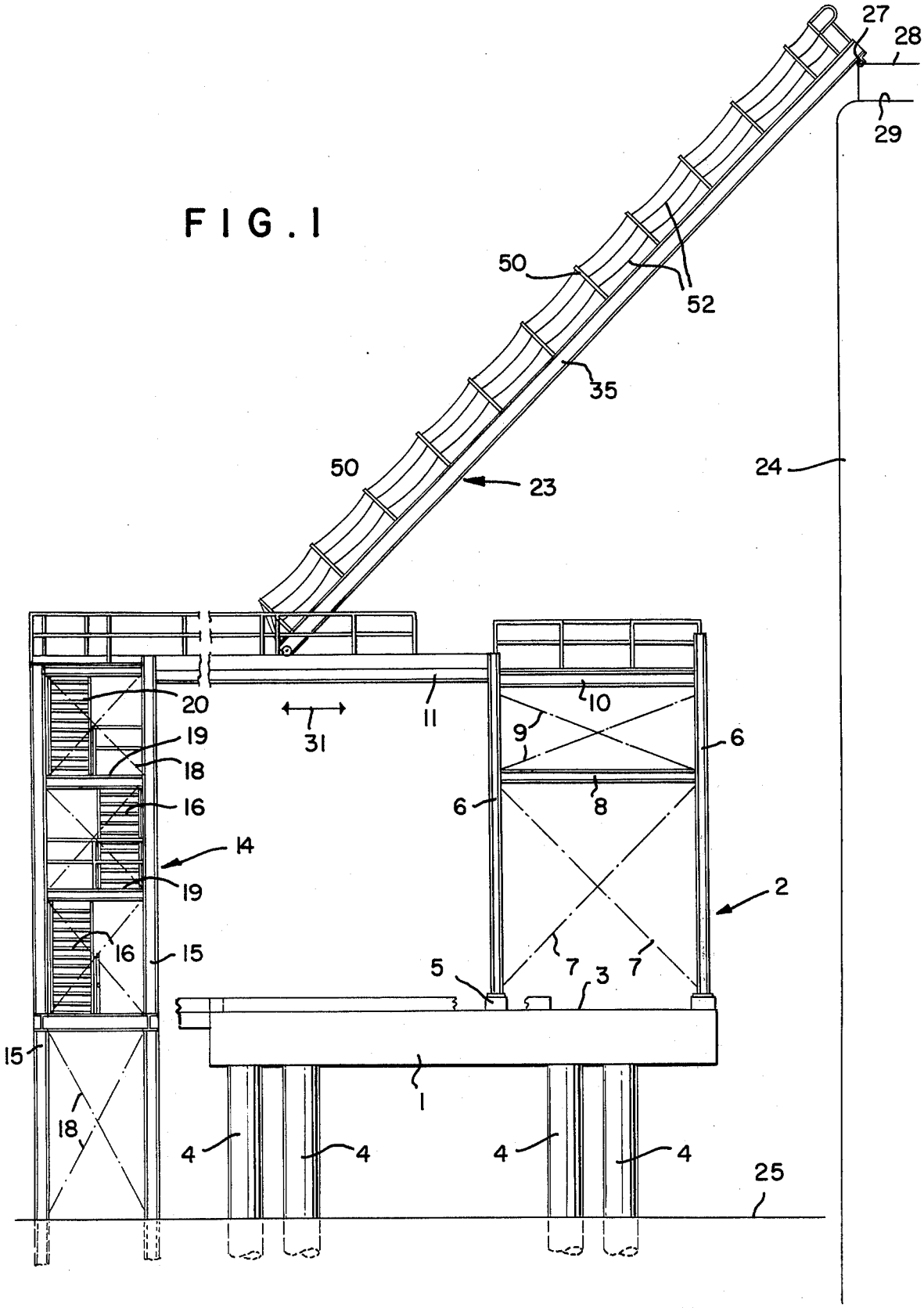
FIG. 1 shows generally in elevation, the relative arrangement of the sides of the tanker, barge or vessel and its top deck and the now existing docking area and platform adjacent to which the vessel is adapted to be moved and schematically represents the tower, piling and stair formation at the end of the span connecting the tower structure on the existing docking or platform area.

Referring now to the drawings for a specific example of a preferred form of the invention the existing platform 1 of the dock or quay normally has a bracing arrangement 2 supported thereon to form a tower structure approximately adjacent to its edge. The vessel which is to be unloaded or loaded is intended to be moored adjacent to this platform in either operation. The tower-like bracing arrangement 2 is normally supported to extend vertically up from a load plate 3 which is at the upper surface of the existing platform. This bracing is set so that it extends from the platform and each is at some known distance above mean low water mark. The platform and its load plate 3 are supported upon piles 4 which are driven into the ground to a distance to set them at a fixed and stable position.

The tower bracing arrangement 2 is suitably supported at various points 5 which are usually arranged in a generally square or rectangular configuration relative to each other. This bracing forms the anchoring points for uprights 6 which extend outwardly therefrom.

This plurality of uprights 6 is cross-braced so that all components are braced by braces 7 (shown only as dotted lines for convenience). Then, at a predetermined height above the load plat 3 to which the uprights of the tower are secured there is usually a support plate 8, and from this plate to the top of the uprights 6 there is additional bracing 9 to connect the plate 8 and the uprights to a plate member 10. A gangway member 11 (later to be further dicussed) is secured to this combination in any desired fashion.

The gangway carriage support member 11 extends outwardly as a span to be supported at its opposite end upon another upwardly extending support tower or the like 14. The tower 14 is formed from upright members 15 which usually constitute piles which are driven below the means low water mark 25 and the piles 4 extend above this same plane. These piles when in a group are spaced along a generally square or rectangular pattern to provide a tower which supports a stairway 16. The stairway, as will later be seen more particularly, extends upwardly to an elevation substantially corresponding to that of the gangway member 11 as it extends outwardly from the tower-like bracing arrangement 2 and is essentially parallel to the existing platform 1l.

The upright members 15 are cross braced, as by the diagrammatically indicated bracings 18. Between the level of the platform 1 and the top of the tower 14 there are several landing regions 19 and the stair flights 20 alternate from one side to the other in the regions between the several landing regions. This makes it easy for workmen to move between different levels during the course of the loading or unloading operations.

It was above stated that the gangway member 11 extends between the top of the bracing tower 2 and the top of the tower 14. This gangway support span is then secured to each of these members and provides a means to mount a plurality of rails or channels for providing for movement of a gangway 23 rested upon the gangway support carriage provided by span 11. The gangway 23 is movable and is fastened to the side of the vessel or ship whose side edge 24 is brought adjacent to the dock or quay. The vessel floats in the water and extends below the mean low water mark 25 upwardly for a substantial distance above the plane of the platform 1 and even the span 11 between the bracing arrangement 2 and the tower 14. As is clearly shown the upper end of the gangway 23 is pivotally mounted on a pivoting member 27 at about the deck level 28 which extends above the top deck of the ship 29. The gangway 23 is usually quite long and extends from the vessel's deck to the gangway support span 11 in such a way that it can move laterally back and forth along the path of the double arrow 31 depending upon the water level at the vessel and upon the instantaneous loading of the vessel to carry it deeper into the water or to permit it to rise in the water relative to the platform 1.

The end of the gangway which is pivoted to the upper ship's rail can be held by practically any hinged form of mounting so long as this mounting maintains the connection between the end of the gangway and the vessel and will not readily break away from the vessel. It is evident that as the vessel rises or falls relative to the platform and the dock or quay to which it is moored it is essential that the gangway be permitted to move back and forth along the span 11. Thus, with each movement, the gangway assumes a different angle and must be guided and held so that the resulting change in angular position is tolerable and any tendency to torsional twist at this time is precluded.

Figure 2:
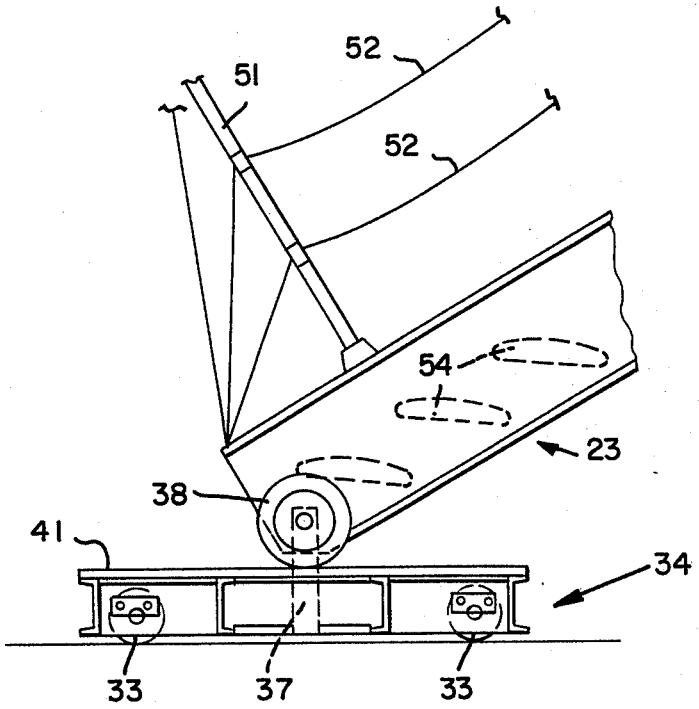
FIG. 2 is an elevation transverse section of FIG. 1 showing the relative arrangement of the end of the movable gangway together with the rollers thereon which are adapted to move back and forth longitudinally of the span connecting the driven piles and stairwell structure and the docking area.

The longitudinal movement along the gangway support span 11 on path 31 is insured by roller members 33 (see particularly FIGS. 2 and 3) which are secured in any desired fashion to the lower end of the gangway. The rollers rest upon the upper surface of the gangway supporting span 11 and permit ready movement, as desired, of the gangway along the span. As shown, the rollers 33 are preferably held at the bottom of the outer side rails 35 of the gangway in such fashion that when the gangway is dropped or lowered to the surface of the span 11 they rest near the edges of this support.

The most important feature of the present invention is the presentation of structure such that when the gangway lower end moves back and forth along the span 11 along the path 31 it is so held as to be generally incapable of being supported in anything other than in a non-twisting position. Thereby the gangway is maintained in such a fashion that any pathway along the gangway will be maintained in the desired plane relative to the span and to the ship from which it is carried. This positioning is achieved by providing a gangway carriage 34 (see FIGS. 2 to 4) running lengthwise of the span 11 and upon which carriage 34 a guiding roller structure 38 can be moved and which can be held to rest via carriage rollers 33 on the span surface 11. The rollers 38 of this structure are carried at the end of a support member 39 whose central region 40 straddles the pivot 37 and provides in combination therewith a structure which will prevent any torsional twist of the gangway 23 as it is moved over the relative to the gangway span support 11. The rollers 38 are held (as particularly exemplified by FIG. 4 of the drawings) at the lower end of the gangway 23 and the rollers 33 are fastened to the underside of the side rails 35 of the carriage. These rollers 38 are caused to straddle the pivot 37 (as above noted) so that the entire structure can move upon the cover plate 41 which extends over a part of the gangway span 11 and which moves therealong as the carriage 34 travels via rollers 33. The rollers 38 are then at the far end of the gangway from that at which it is pivoted from the ship deck.

A side railing 50 of any desired form is attached to the gangway and forms a member to be grasped, as desired, by any party moving along the gangway between the deck of the ship and the gangway supporting span 11. In one form there is thus a railing 52 extended between the ends of the gangway. Usually a series of steps with treads 54 and risers 55 (see FIG. 2) provide for easy movement along the gangway. In the alternative, there may be a friction surface (not shown) extended between the ends of the gangway for providing a surface upon which a party may move between the gangway ends. The stairways, when used, may be of various constructions but one of the most satisfactory is of the general formation similar to the structures used commonly on escalators so that the treads and risers may occupy different angles relative to each other, depending upon the angle existing between the top of the gangway at the vessel's deck and the angle at which this gangway rests upon the gangway span while the stair treads are maintained parallel. It is not, of course, necessary that the stairway be a moving stairway but merely that it be one which is capable of assuming a different angular relationship between the treads and risers when the lower end of the gangway is changed in its relative position from one near the edge of the ship to one outward along the gangway support 11.

Various modifications of the foregoing structure may readily be made and it is intended that this description shall constitute one exemplifying structural principles for ready use of the desired unit.

I claim:

1. A structure for providing a connecting link between a vessel and a docking area adjacent to which the vessel is adapted to be moved for loading and unloading comprising in combination:

a movable gangway structure of selectively fixed operative length from one end of the gangway structure to the other end thereof, means to support one end of the gangway structure on the vessel in any position of movement of the gangway structure with respect to the vessel, a longitudinal gangway supporting member disposed at the docking area at a height above the mean low water level, carriage means disposed for movement back and forth along the longitudinal member and supporting the other end of the gangway structure on the longitudinal member in any position of movement of the gangway structure with respect to the longitudinal member and at any corresponding position of movement of the carriage means along the longitudinal member, and conjoint vertical and horizontal articulation connection means operatively interposed between said other end of the gangway struxture and the carriage means to preclude freely and continuously the tortional twisting of the gangway structure in any position of movement thereof with respect to the carriage means and at any corresponding position of movement of the carriage means along the longitudinal member.

2. The structure of claim 1 wherein the articulation connection means includes a vertical axis pivot operatively positioned to permit relative rotational movement between said other end of the gangway structure and the carriage means.

3. The structure of claim 1 wherein the articulation connection means includes gangway roller means secured to said other end of the gangway structure along a horizontal axis and operatively positioned for contact with the carriage means to permit relative rotational movement between said other end of the gangway structure and the carriage means.

4. The structure of claim 1 wherein a first support tower having support means is located and supported substantially adjacent to the edge of the docking area at which the vessel is adapted to be moored, and a second support tower having support means is located and supported spaced away from the edge of the docking area and at a region positionally approximating the location of the first tower along a path crosswise of the edge of the docking area and in spaced relation to the relative location of the first tower which is substantially adjacent to the edge of the docking area, the longitudinal member extending between the two towers in the form of a connecting span at a predetermined height thereon and supported thereby between its ends at said height above the mean low water level.

5. The structure of claim 1 wherein the articulation connection means includes a vertical axis pivot operatively positioned to permit relative rotational movement between said other end of the gangway structure and the carriage means about a vertical axis, and spaced apart roller means secured to said other end of the gangway structure along a horizontal axis and operatively positioned for straddling the vertical axis pivot and for supportive contact with the carriage means to permit relative rotational movement between said other end of the gangway structure and the carriage means about a horizontal axis in any position of relative movement between said other end of the gangway strucutre and the carriage means about the vertical axis and in any position of movement of the carriage means back and forth along the longitudinal member.

6. The structure of claim 5 wherein the carriage means includes longitudinal member roller means secured to the carriage means and operatively positioned for supportive contact with the longitudinal member to permit movement of the carriage means back and forth along the longitudinal member.

7. The structure of claim 5 wherein a first support tower having support means is located and supported substantially adjacent to the edge of the docking area at which the vessel is adapted to be moored, and a second support tower having support means is located and supported spaced away from the edge of the docking area and at a region positionally approximating the location of the first tower along a path crosswise of the edge of the docking area and in spaced relation to the relative location of the first tower which is substantially adjacent to the edge of the docking area, the longitudinal member extending between the two towers in the form of a connecting span at a predetermined height thereon and supported thereby between its ends at said height above the mean low water level.

8. The structure of claim 7 wherein means are provided to brace each tower relative to its support means to maintain the rigid position thereof and to permit full movement of the carriage means and gangway structure along the longitudinal member connecting the towers.

9. The structure of claim 7 wherein the longitudinal member is provided with a substantially horizontally extending resting surface of substantially planar and uniform character for accommodating movement of the carriage means back and forth therealong.

10. The structure of claim 7 wherein the gangway structure is provided with step members having treads extending for the length of the gangway structure and capable of limited relative movement with respect to each other so that the treads are maintained substantially parallel to the horizontal without regard to the angle made between the gangway structure and the longitudinal supporting member, and is further provided with a railing extending for the length of the gangway structure on each side thereof to provide a support for travel along the gangway structure.

* * * * *